US012624535B2

(12) United States Patent
Kihara

(10) Patent No.: US 12,624,535 B2
(45) Date of Patent: May 12, 2026

(54) CONTROL DEVICE AND WATER SUPPLY AND DRAINAGE SYSTEM

(71) Applicant: LIXIL Corporation, Tokyo (JP)

(72) Inventor: Yukiko Kihara, Tokyo (JP)

(73) Assignee: LIXIL Corporation, Tokyo (JP)

( * ) Notice: Subject to any disclaimer, the term of this patent is extended or adjusted under 35 U.S.C. 154(b) by 154 days.

(21) Appl. No.: 18/694,364

(22) PCT Filed: Sep. 15, 2022

(86) PCT No.: PCT/JP2022/034547
§ 371 (c)(1),
(2) Date: Mar. 21, 2024

(87) PCT Pub. No.: WO2023/048061
PCT Pub. Date: Mar. 30, 2023

(65) Prior Publication Data

US 2025/0129586 A1 Apr. 24, 2025

(30) Foreign Application Priority Data

Sep. 27, 2021 (JP) ..... 2021-157197

(51) Int. Cl.
*E03D 5/10* (2006.01)

(52) U.S. Cl.
CPC ..... *E03D 5/105* (2013.01)

(58) Field of Classification Search
CPC ..... E03D 5/105
See application file for complete search history.

(56) References Cited

U.S. PATENT DOCUMENTS

| | | | | |
|---|---|---|---|---|
| 11,886,213 | B2 * | 1/2024 | Heydari | G06Q 10/20 |
| 2011/0010831 | A1 | 1/2011 | Lee | |
| 2020/0284006 | A1 * | 9/2020 | Kramer | E03D 5/105 |
| 2020/0392710 | A1 | 12/2020 | Saruta | |
| 2022/0251815 | A1 | 8/2022 | Saruta | |

FOREIGN PATENT DOCUMENTS

| | | | |
|---|---|---|---|
| EP | 0348886 | A1 | 1/1990 |
| JP | H2-113200 | A | 4/1990 |
| JP | H7-189312 | A | 7/1995 |
| JP | 2002-106012 | A | 4/2002 |
| JP | 2005-299092 | A | 10/2005 |
| JP | 2011-52531 | A | 3/2011 |
| JP | 2011-511189 | A | 4/2011 |
| JP | 2017-48673 | A | 3/2017 |
| JP | 2018-96164 | A | 6/2018 |
| JP | 2018-159203 | A | 10/2018 |
| JP | 2018-162649 | A | 10/2018 |
| JP | 2019-27185 | A | 2/2019 |
| WO | 2019/163202 | A1 | 8/2019 |

* cited by examiner

*Primary Examiner* — Christine J Skubinna
(74) *Attorney, Agent, or Firm* — Morrison & Foerster LLP

(57) ABSTRACT

A control device may comprise a controller configured to control water volume to be supplied to one or more specific sanitary facility devices of the plurality of sanitary facility devices by using a first indicator and a second indicator, the first indicator being related to an actual water volume actually used in a plurality of sanitary facility devices, and the second indicator being related to a target water volume to be used in the plurality of sanitary facility devices, and the controller being configured to control the water volume to prevent the actual water volume to exceed the target water volume.

12 Claims, 5 Drawing Sheets

CONTROL DEVICE AND WATER SUPPLY AND DRAINAGE SYSTEM

CROSS-REFERENCE TO RELATED APPLICATIONS

This application is a national stage application under 35 U.S.C. 371 of International Application No. PCT/JP2022/034547, filed Sep. 15, 2022, which claims the priority of Japanese Application No. 2021-157197, filed Sep. 27, 2021. The entire contents of each priority application is incorporated herein by reference.

FIELD OF THE DISCLOSURE

Technologies disclosed herein relate to a control device and a water supply and drainage system for a plurality of sanitary facility devices.

BACKGROUND OF THE DISCLOSURE

Japanese Patent Application Publication No. 2018-162649 describes a technology for controlling the volume of flushing water supplied to a flush toilet.

SUMMARY OF THE DISCLOSURE

In the above technology, a water volume used in a single sanitary facility device is controlled. This specification provides a technology for controlling water volumes used in specific sanitary facility device(s), considering the total volume of water used in a plurality of sanitary facility devices.

The technology disclosed in the specification relates to a control device. The control device may comprise a controller configured to control water volume to be supplied to one or more specific sanitary facility devices of the plurality of sanitary facility devices by using a first indicator and a second indicator, the first indicator being related to an actual water volume actually used in a plurality of sanitary facility devices, and the second indicator being related to a target water volume to be used in the plurality of sanitary facility devices, and the controller being configured to control the water volume to prevent the actual water volume to exceed the target water volume.

A water supply and drainage system including a plurality of sanitary facility devices and the above control device is also novel and useful.

DETAILED DESCRIPTION OF THE DISCLOSURE

First Embodiment (Configuration of Water Supply and Drainage System)

Figure 1:
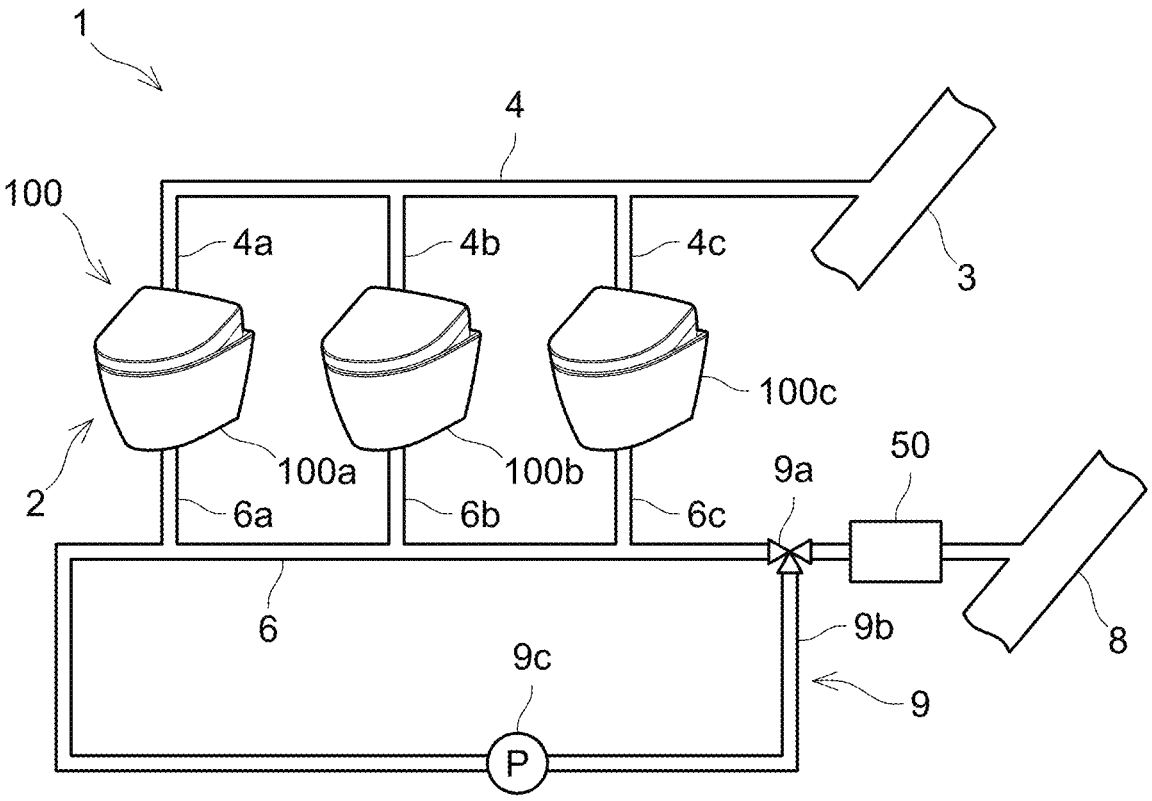
FIG. 1 schematically shows a pipe layout for flush toilets in a management area.

As shown in FIG. 1, a water supply and drainage system 2 including a plurality of flush toilets 100 is installed in a management area 1. In FIG. 1, three flush toilets 100*a*, 100*b*, and 100*c* are installed. The number of flush toilets 100 installed in the management area 1 is not limited. The management area 1 is not particularly limited and may be one building, one amusement park, one zoo, one town, at least one area of a city, or the like. One town and one city include at least any one of one or more buildings and one or more outdoor facilities. In the management area 1, drainage water from the plurality of flush toilets 100 within the management area 1 gathers to a single drainpipe 6 in the management area 1 and flows to a sewer pipe 8 installed outside the management area 1. The management area 1 is an area where a target water volume to be used within a specific time period, such as one month, is predetermined. The management area 1 is an area where water volumes to be used are managed integrally. The unit for "water volume" is liters. In a variant, the unit for "water volume" may be a unit other than liters, for example, gallons.

Water is supplied to each of the plurality of flush toilets 100 from a water supply pipe 4 connected to a clean water pipe 3 installed outside the management area 1. The flush toilets 100 are connected to branch pipes 4*a*, 4*b*, 4*c* branching off from the water supply pipe 4, respectively. The flush toilets 100 are connected to branch pipes 6*a*, 6*b*, 6*c*, respectively. Water used in the respective flush toilets 100 flows through the branch pipes 6*a*, 6*b*, 6*c* into the drainpipe 6. Excrements dropped into the respective flush toilets 100 also flow through the branch pipes 6*a*, 6*b*, 6*c* into the drainpipe 6. The water and excrements in the drainpipe 6 flow through the drainpipe 6 and reach the sewer pipe 8.

A circulation path 9 is connected to the drainpipe 6. The circulation path 9 includes a three-way valve 9*a*, a circulation pipe 9*b*, and a pump 9*c*. The three-way valve 9*a* is located in a portion of the drainpipe 6 that is downstream of positions at which the branch pipes 6*a*, 6*b*, and 6*c* are connected to the drainpipe 6. One end of the circulation pipe 9*b* is connected to the drainpipe 6 via the three-way valve 9*a*. The other end of the circulation pipe 9*b* is connected to an upstream end of the drainpipe 6. The three-way valve 9*a* switches the circulation pipe 9*b* between a state in which the circulation pipe 9*b* is in communication with the drainpipe 6 and a state in which the circulation pipe 9*b* is shut off from the drainpipe 6. The pump 9*c* pumps the water in the drainpipe 6 from the downstream side toward the upstream side of the drainpipe 6 through the circulation pipe 9*b*.

A flow sensor 50 is located downstream of the three-way valve 9*a* in the drainpipe 6. The flow sensor 50 is located in a portion of the drainpipe 6 that is downstream of the positions at which the branch pipes 6*a*, 6*b*, and 6*c* connected to the flush toilets 100 are connected to the drainpipe 6. The flow sensor 50 detects the total of water volumes used in the flush toilets 100 and drained into the drainpipe 6. The flow sensor 50 may be either of an ultrasonic sensor device or an electromagnetic sensor device.

Figure 2:
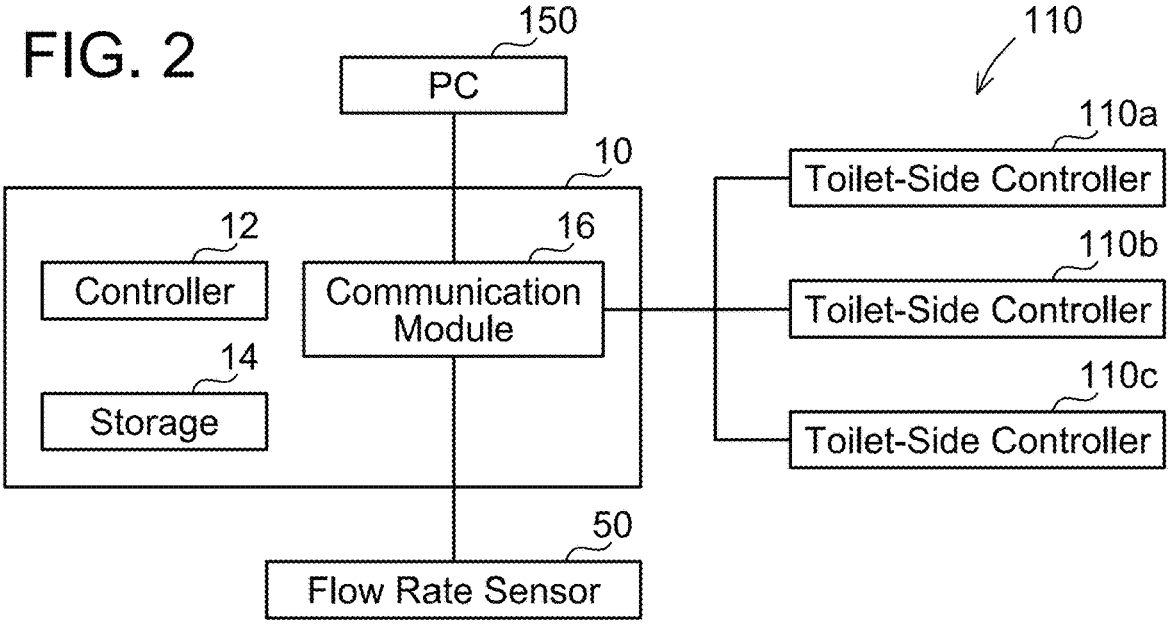
FIG. 2 shows a block diagram illustrating a system configuration of a water supply and drainage system.

As shown in FIG. 2, the water supply and drainage system 2 includes a control device 10 in addition to the plurality of flush toilets 100. The control device 10 controls the plurality of flush toilets 100. The control device 10 includes a controller 12, a storage 14, and a communication module 16.

The controller 12, the storage 14, and the communication module 16 are communicatively connected by a bus bar, which is not shown. The controller 12 includes a CPU. The controller 12 controls the plurality of flush toilets 100 by the CPU executing processes according to a computer program.

The storage 14 includes at least one type of memory among, for example, a hard disk, ROM and RAM. The storage 14 stores a computer program for the controller 12 and necessary data for processes executed by the controller 12.

The communication module 16 includes an interface for communicatively connecting the controller 12 to other devices. For example, the communication module 16 may include at least one of an interface for communication with a LAN (abbreviation of Local Area Network) and an interface for wireless communication. The controller 12 is communicatively connected via the communication module 16 to a plurality of toilet-side controllers 110, the flow sensor 50, and a PC 150.

The toilet-side controllers 110 are located in the flush toilets 100, respectively. FIG. 2 shows three toilet-side controllers 110*a*, 110*b*, 110*c* located in the three flush toilets 100*a*, 100*b*, 100*c*, respectively. The number of toilet-side controllers 110 is the same as the number of flush toilets 100. The controller 12 provides to the toilet-side controller 110*a* single-supply water volume instruction information which indicates a water volume to be supplied when the flush toilet 100*a* is flushed once. When receiving an operation by a user of the flush toilet 100*a*, the toilet-side controller 110*a* supplies flushing water from the clean water pipe 3 to the flush toilet 100*a*. The toilet-side controller 110*a* supplies flushing water in a single-supply water volume SV indicated by the received single-supply water volume instruction information to the flush toilet 100*a*. When receiving a new single-supply water volume instruction information, the toilet-side controller 110*a* updates the single-supply water volume instruction information. Thus, the flushing water volume to be supplied to the flush toilet 100*a* is changed. In a variant, the toilet-side controller 110*a* may supply flushing water to the flush toilet 100*a* in response to detection by a sensor device such as a human detecting sensor and at regular intervals by a timer.

Every time the toilet-side controller 110*a* supplies flushing water to the flush toilet 100*a*, the toilet-side controller 110*a* transmits to the control device 10 a combination of identification information indicating the flush toilet 100*a* and flushing information indicating the supply of flushing water. The toilet-side controllers 110*b* and 110*c* perform the same control as the one performed by the toilet-side controller 110*a* to the flush toilets 100*b* and 100*c*, respectively.

The flow sensor 50 repeatedly transmits to the controller 12 flow volume information indicating a water volume flowing in the drainpipe 6. The PC 150 is a computer of the administrator of the water supply and drainage system 2. In a variant, the PC 150 may be replaced by a portable terminal of the administrator.

(Water Supply Controlling Process)

Figure 3:
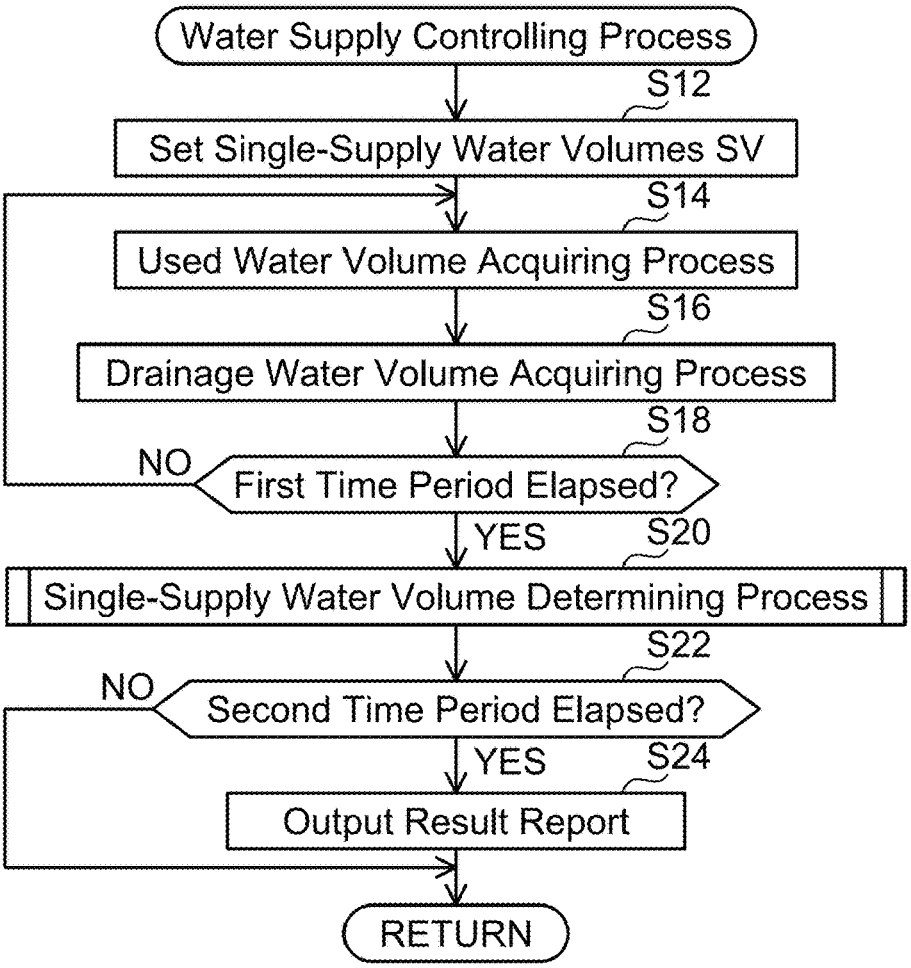
FIG. 3 shows a flowchart of a water supply controlling process according to a first embodiment.

The controller 12 controls flushing water volumes to be supplied to the flush toilets 100 through a water supply controlling process. The water supply controlling process is initiated when the control device 10 is activated. As shown in FIG. 3, in S12, the controller 12 sets single-supply water volumes SV to be supplied when the respective flush toilets 100 are flushed once. Specifically, the controller 12 transmits single-supply water volume instruction information to each of the plurality of toilet-side controllers 110. When the single-supply water volume instruction information is received, the toilet-side controller 110*a* sets the single-supply water volume SV indicated by the single-supply water volume instruction information as a flushing water volume for the flush toilet 100*a*. In the same manner, the toilet-side controllers 110*b* and 110*c*, when receiving the single-supply water volume instruction information, set the single-supply water volumes SV indicated by the single-supply water volume instruction information as flushing water volumes for the flush toilets 100*b* and 100*c*.

In S12, the controller 12 further stores, for each of the plurality of flush toilets 100, the identification information of the flush toilet 100 and SV information indicating its single-supply water volume SV in association with each other in the storage 14. The controller 12 further stores count information indicating a count of flushing in association with the identification information and the SV information in the storage 14. In S12, information indicating a count of flushing is 0 is stored as the count information. In S12, the controller 12 also starts measuring a time period from when the single-supply water volumes SV were set. In a variant, the controller 12 may store the SV information in the storage 14 without associating them with the identification information of the flush toilets 100.

For the management area 1, a water volume limit is set to limit the total of flushing water volumes to be used in the plurality of flush toilets 100 within a specific time period. For the management area 1, a target value is also set for the total of flushing water volumes to be used when the flush toilets 100 are flushed once. That is, the target value indicates the total of flushing water volumes to be used in the flush toilets 100 when the flush toilets 100 are each flushed once. The target value may be set based on the counts of flushing in the flush toilets 100 so as not to exceed the water volume limit. Water volume limit information indicating the water volume limit is stored in advance in the storage 14. The administrator can operate the PC 150 to change the water volume limit by changing the water volume limit information stored in the storage 14. In S12 immediately after the controller 12 has been activated, the controller 12 calculates the single-supply water volumes SV by calculating (target value/the number of flush toilets 100).

In S14, the controller 12 executes a used water volume acquiring process. Specifically, every time flushing water is supplied in the flush toilet 100*a*, the controller 12 receives from the toilet-side controller 110*a* a combination of the identification information indicating the flush toilet 100*a* and the flushing information indicating the supply of flushing water. When the combination of the identification information and the flushing information is received, the controller 12 adds "1" to the number indicated by the count information associated with the identification information that matches the received identification information in storage 14. The controller 12 executes the same process to each of the plurality of flush toilets 100.

In S16, the controller 12 executes a drainage water volume acquiring process. Specifically, the controller 12 integrates flow volumes repeatedly acquired from the flow sensor 50. The controller 12 keeps executing the processes of S14 and S16 until a first time period elapses (YES in S18). The first time period is preset by the administrator. The first time period is shorter than the specific time period, for example, one week. The first time period may be changed by the administrator operating the PC 150.

Once the first time period has elapsed (YES in S18), the controller 12 executes a single-supply water volume determining process in S20 to determine single-supply water volumes SV. Single-supply water volumes SV to be newly set are thereby determined. In S22, the controller 12 determines whether a second time period has elapsed or not since the process of S22 was executed last time. The second time period is longer than the first time period. The second time period may be as long as the specific time period. In a case where the controller 12 executes the process of S22 for the first time after the start of the water supply controlling process, the controller 12 determines whether the second time period has elapsed or not since the water supply controlling process started. If it is determined that the second time period has elapsed (YES in S22), the controller 12 transmits integrated water volume information indicating an integral of used water volumes integrated in S14 within the second time period to the PC 150 in S24, and the process returns to S12. If it is determined that the second time period has not elapsed (NO in S22), the flow skips S24 and returns to S12.

Then, in S12, the controller 12 sets the single-supply water volumes SV determined in S20 for the respective flush toilets 100.

(Single-Supply Water Volume Determining Process)

Figure 4:
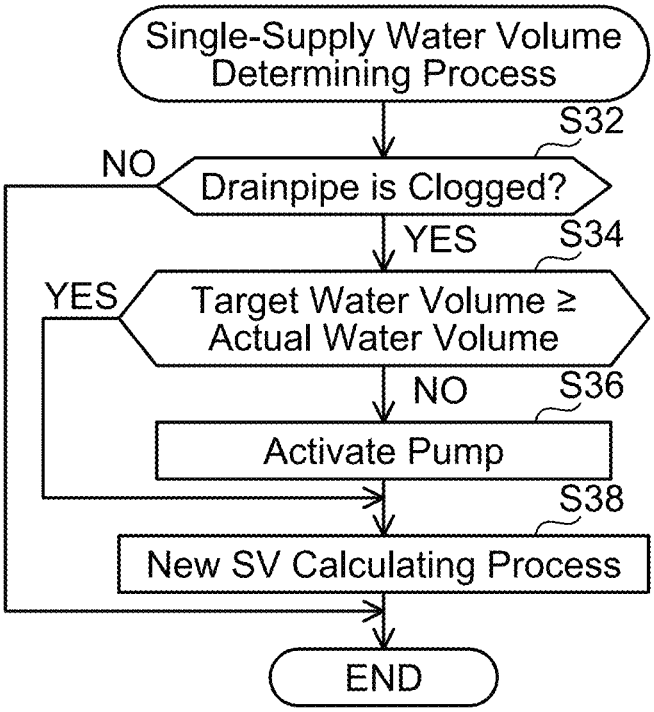
FIG. 4 shows a flowchart of a single-use water volume determining process according to the first embodiment.

Referring to FIG. 4, the single-supply water volume determining process of S20 executed by the controller 12 is described. In S32, the controller 12 determines whether the drainpipe 6 is clogged or not. Specifically, the controller 12 determines that the drainpipe 6 is clogged if a water volume difference exceeds a predetermined value, wherein the water volume difference is a difference between the water volume actually used within the first period time, i.e., an integral of used water volumes within the first time period acquired in S14 (hereinafter referred to as "actual water volume") and an integral of drainage water volumes within the first time period acquired in S16. The actual water volume is calculated by integrating values obtained by multiplying the single-supply water volumes SV for the respective flush toilets 100 by corresponding counts of flushing. The predetermined value may be for example 0.1 times the actual water volume. Flushing water used in the plurality of flush toilets 100 flows into the drainpipe 6. Therefore, an integral of drainage water flow volumes detected by the flow sensor 50 should be approximately equal to the integral of used water volumes. However, if the drainpipe 6 is clogged, water is blocked in the drainpipe 6 and at least part of the used water does not reach the flow sensor 50. In S32, whether clogging is present or not can be determined by comparing the actual water volume within the first time period with the integral of drainage water volumes.

If it is determined that clogging is present (YES in S32), i.e., if the water volume difference between the actual water volume and the integral of drainage water volumes acquired in S16 exceeds the predetermined value, the controller 12 determines in S34 whether the actual water volume is less than a target water volume or not. The target water volume is calculated by {water volume limit×(first time period/specific time period)}. If it is determined that the actual water volume is equal to or greater than the target water volume (NO in S34), the controller 12 switches the three-way valve 9*a* from the state in which the circulation pipe 9*b* is shut off from the drainpipe 6 to the state in which the circulation pipe 9*b* is in communication with the drainpipe 6 in S36. The controller 12 then activates the pump 9*c* only for a predetermined time period (e.g., one minute). As a result, drainage water flows into the circulation pipe 9*b*. The drainage water flowing in the circulation pipe 9*b* flows into the upstream end of the drainpipe 6. By allowing the drainage water to circulate through the circulation pipe 9*b*, the clogging in the drainpipe 6 is removed.

If it is determined that the actual water volume is less than the target water volume (YES in S34), the flow skips S36 and proceeds to S38. In S38, the controller 12 calculates new single-supply water volumes SV. Specifically, the controller 12 calculates a new single-supply water volume SV={current single-supply water volume SV+(target water volume−actual water volume)/the number of flush toilets}. In the case where it is determined that the actual water volume is less than the target water volume (YES in S34), new single-supply water volumes SV are larger than the current single-supply water volumes SV. As a result, flushing water volumes to be supplied to the flush toilets 100 are increased. This can remove the clogging in the drainpipe 6. In the case where it is determined that the actual water volume is less than the target water volume (YES in S34), the clogging in the drainpipe 6 can be removed without the pump 9*c* being activated in S36. A larger difference between the target water volume and the actual water volume leads to larger new single-supply water volumes SV. A larger difference between the target water volume and the actual water volume leads to larger flushing water volumes and thus suppresses clogging.

In the case where it is determined that the actual water volume is equal to or greater than the target water volume (NO in S34), the new single-supply water volumes SV are less than the current single-supply water volumes SV. This reduces the flushing water volumes to be used in the flush toilets 100. In the case where it is determined that the actual water volume is equal to or greater than the target water volume (NO in S34), the pump 9*c* is actuated in S36 so that the clogging in the drainpipe 6 can be removed even when the flushing water volumes are reduced. Since the plurality of flush toilets 100 is installed in the management area 1, the flushing water volume in the management area 1 can be reduced and the clogging in the drainpipe 6 can be prevented.

If it is determined that there is no clogging (NO in S32), the single-supply water volume determining process is terminated without determining new single-supply water volumes SV. In this case, the single-supply water volumes SV are not updated in S12.

Flushing water volumes used differ among the flush toilets 100 depending on the frequency of use. If flushing water volumes are adjusted separately for the flush toilets 100, a single-supply water volume SV needs to be reduced for a frequently used flush toilet. In the single-supply water volume determining process, single-supply water volumes SV are determined by using the target water volume to be used in the plurality of flush toilets 100 and the actual water volume actually used in the plurality of flush toilets 100. The difference between the target water volume and the actual water volume can be distributed among the flush toilets 100. The single-supply water volumes SV do not have to be adjusted depending on the usage of individual flush toilets 100.

In a variant, the identification information may not be assigned to each of the plurality of flush toilets 100 such as the first embodiment. The control device 10 may execute the processes without using the identification information of the flush toilets 100.

The plurality of flush toilets 100 is an example of "a plurality of sanitary facility devices", the actual water volume is an example of "first indicator", and the target water volume is an example of "second indicator". The branch pipes 6*a*, 6*b*, 6*c* are each an example of "first drainpipe", and the drainpipe 6 is an example of "second drainpipe". The circulation pipe 9*b* is an example of "water pipe".

Second Embodiment

Differences from the first embodiment will be described. In this embodiment, the process of calculating new single-supply water volumes SV in S38 differs from that of the first embodiment. In S38, the controller 12 calculates a single-supply water volume SV for each of the plurality of flush toilets 100 depending on the frequency of use of the flush toilet. The controller 12 sets a larger flushing water volume for a more frequently used toilet. Specifically, the controller 12 uses the count information counted in S14 to calculate, for each of the plurality of flush toilets 100, a new single-supply water volume SV={current single-supply water volume SV+(target water volume−actual water volume)×(the count of flushing in the flush toilet/the total count of flushing in the plurality of flush toilets)}. For a flush toilet with the count of flushing "0", a smaller single-supply water volume SV is set than a single-supply water volume SV for a flush toilet with the count of flushing "1" or greater.

A larger single-supply water volume SV is set for a more frequently used flush toilet. From a more frequently used flush toilet, more excretions and toilet paper (hereinafter simply referred to as "excretions"), which may cause clogging, are flushed down into the drainpipe 6. Therefore, a portion of the drainpipe 6 located downstream of the more frequently used flush toilet is more likely to be clogged with the excretions. By increasing the single-supply water volume SV for the more frequently used flush toilet, the excretions, which may cause clogging, can be easily pushed out to the sewer pipe 8.

The frequency of use is an example of "third indicator" and "fourth indicator".

Third Embodiment

Differences from the first embodiment will be described. In this embodiment, the controller 12 corrects single-supply water volumes SV in S12. The controller 12 has a calendar function. In S12, the controller 12 refers to the calendar function and calculates corrected single-supply water volumes SV by multiplying the single-supply water volumes SV by a season coefficient. The season coefficient is a value equal to or less than 1.0. The season coefficient varies depending on the time of year. Specifically, during the time of year with relatively high temperatures (e.g., from June through August in Japan), the season coefficient is 0.8. During the time of year with relatively low temperatures (e.g., from December through February in Japan), the season coefficient is 1.0. During the other time of year, the season coefficient is 0.9. In a variant, the season coefficient may vary depending on the temperature. For example, it may be larger for higher temperatures and may be decreased as the temperature decreases.

In a variant, the process of S12 in the second embodiment may be replaced by the process of S12 in the third embodiment. The season coefficient may be equal to or greater than 1.0.

The viscosity of drainage water in the drainpipe 6 decreases under higher temperatures. When the viscosity of drainage water is lower, less water is required to flow through the drainpipe 6. In this embodiment, single-supply water volumes SV are reduced during the time of year with relatively high temperatures, and thus flushing water volumes can be reduced during the time of year with relatively low drainage water viscosity.

The time of year is an example of "fourth indicator".

Fourth Embodiment

Differences from the first embodiment will be described. In this embodiment, the controller 12 corrects single-supply water volumes SV in S12. The controller 12 has a calendar function and a clock function. Days and time slots when users of the management area 1 do not use the management area 1 are registered in advance in the calendar function. In S12, the controller 12 refers to the calendar function and the clock function and calculates corrected single-supply water volumes SV by multiplying the single-supply water volumes SV by a date-and-time coefficient. The date-and-time coefficient is a value equal to or less than 1.0. The date-and-time coefficient varies depending on the time of day, the day of week, holiday, and weekday. Specifically, the date-and-time coefficient is 1.0 for daytime of weekdays (e.g., from 8:00 a.m. to 6:00 p.m. on Monday through Friday). The date-and-time coefficient is 0.8 for mornings and nights of weekdays (e.g., time slots other than 8:00 a.m. to 6:00 p.m. on Monday through Friday). The date-and-time coefficient is 0.6 for holidays (e.g., Saturday, Sunday, and national holidays). In a variant, based on the frequency of use per day of week and time of day, the date-and-time coefficient may be increased for more frequency of use and decreased for less frequency of use.

At least one of the process of S12 in the second embodiment and the process of S12 in the second embodiment may be replaced by the process of S12 in the fourth embodiment. The date-and-time coefficient may be equal to or greater than 1.0. In S12, single-supply water volumes SV may be corrected using the season coefficient in addition to the date-and-time coefficient. For example, the controller 12 may correct single-supply water volumes SV by multiplying the single-supply water volumes SV by the date-and-time coefficient and the season coefficient.

The drainpipe 6 is less likely to be clogged with less frequency of use. When the frequency of use is low, clogging is unlikely to occur even if flushing water volume are reduced. In this embodiment, flushing water volumes used can be reduced when clogging is less likely to occur.

Date and time is an example of "fourth indicator".

Fifth Embodiment

Figure 5:
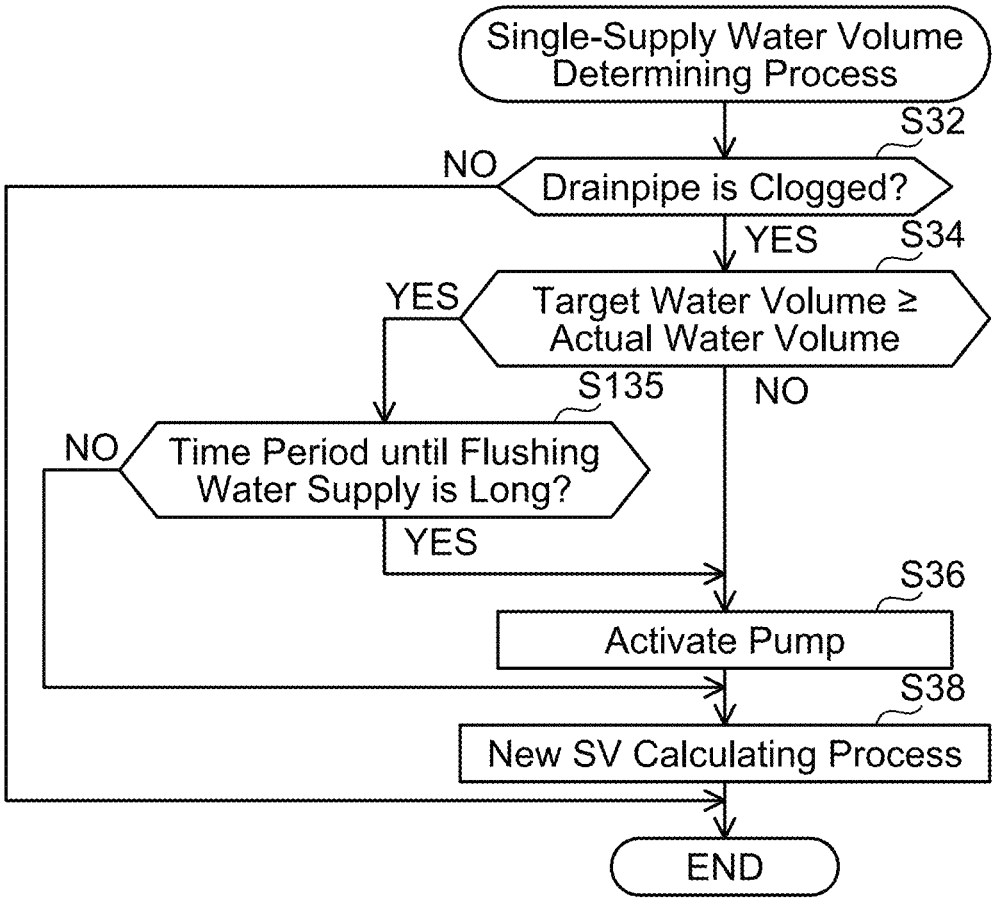
FIG. 5 shows a flowchart of a single-use water volume determining process according to a fifth embodiment.

Differences from the first embodiment will be described. As shown in FIG. 5, in a single-supply water volume determining process of this embodiment, if it is determined that the actual water volume is less than the target water volume in S34 (YES in S34), the controller 12 determines in S135 whether a time period from the present until when flushing water is supplied to any of the plurality of flush toilets 100 is long or not. Specifically, the controller 12 has a calendar function. Days when users of the management area 1 do not use the management area 1 has been registered in advance in the calendar function. The controller 12 uses the calendar function to determine that the time period until flushing water is supplied is long if the present time falls on a holiday (YES in S135). The controller 12 uses the calendar function to determine that the time period until flushing water is supplied is not long if the present time does not fall on a holiday (NO in S135).

In case of YES in S135, the flow proceeds to S36. In S36, the pump 9*c* is activated and the drainage water is thus circulated. Thus, the clogging in the drainpipe 6 can be removed when the time period until flushing water is supplied next is expected to be long. In case of NO in S135, the flow proceeds to S38. When the time period until flushing water is supplied next is expected to be relatively short, the clogging in the drainpipe 6 can be removed by flushing water supplied to any of the plurality of flush toilets 100.

Sixth Embodiment

Differences from the first embodiment will be described. In this embodiment, target drainage water volume information indicating a target drainage water volume is stored in advance in the storage 14. The target drainage water volume indicates a water volume that flows through the unclogged drainpipe 6 when the target water volume is supplied to the plurality of flush toilets 100. The target drainage water volume is determined based on the target water volume. For example, the target drainage water volume is calculated by the target water volumexcoefficient (e.g., 0.9). In S32, the controller 12 determines that there is clogging in the drainpipe 6 (YES in S32) if the integral of drainage water volumes acquired in S16 is less than the target drainage water volume. The controller 12 determines that there is no clogging in the drainpipe 6 (NO in S32) if the integral of drainage water volumes acquired in S16 is equal to or greater than the target drainage water volume.

In S38, the controller 12 sets single-supply water volumes SV for the respective flush toilets 100 depending on the water volume in the drainpipe 6. The controller 12 sets larger flushing water volumes as the integral of drainage water volumes acquired in S16 is larger. Specifically, the controller 12 calculates, for each of the plurality of flush toilets 100, a new single-supply water volume SV={current single-supply water volume SV+(target drainage water volume−integral of drainage water volumes)/the number of toilets}. In this embodiment, the single-supply water volumes SV are the same among the plurality of flush toilets 100.

In this embodiment, the single-supply water volumes SV are determined based on the drainage water volume in the drainpipe 6. Therefore, in S14 of the water supply controlling process, the used water volume does not need to be acquired. The processing load on the control device 10 can thus be reduced.

The integral of drainage water volumes is an example of "first indicator", and the target drainage water volume is an example of "second indicator".

Seventh Embodiment

Differences from the first embodiment will be described. In this embodiment, a process of calculating new single-supply water volumes SV in S38 differs from that of the first embodiment. In S38, the controller 12 sets a single-supply water volume SV for each of the plurality of flushing toilets depending on the length of the drainpipe 6 from the flush toilet to the sewer pipe 8. The controller 12 sets larger flushing water volumes for toilets with longer lengths of the drainpipe 6 from the flush toilets to the sewer pipe 8. Specifically, the controller 12 uses the count information counted in S14 to calculate, for each of the plurality of flush toilets, a new single-supply water volume SV={current single-supply water volume SV+(target water volume−actual water volume)×pipe length coefficient}. The pipe length coefficient for the flush toilet with the longest length of the drainpipe 6 from the flush toilet to the sewer pipe 8 is set as "1.0". A pipe length coefficient for each of the other flush toilets is set as ratio of the length of the drainpipe 6 from the flush toilet to the sewer pipe 8 to the length of the drainpipe 6 from the flush toilet furthest from the sewer pipe 8 to the sewer pipe 8.

Larger single-supply water volumes SV are set for flush toilets with longer lengths of the drainpipe 6 from the flush toilets to the sewer pipe 8. Excretions from flush toilets with longer lengths of drainpipe 6 from the flush toilets to the sewer pipe 8 are more likely to accumulate before reaching the sewer pipe 8. By increasing the single-supply water volumes SV for the flush toilets with longer lengths of the drainpipe 6 from the flush toilets to the sewer pipe 8, excretions which may cause clogging can easily flow to the sewer pipe 8.

The lengths of the drainpipe 6 from the flush toilets to the sewer pipe 8 are examples of "fourth indicator".

Eighth Embodiment

Differences from the first embodiment will be described. In this embodiment, the controller 12 does not execute the process of S16 in the water supply controlling process. In this embodiment, the controller 12 does not execute the process of S32 in the single-supply water volume determining process. In this embodiment, the water volume and clogging in the drainpipe 6 are not used to determine single-supply water volumes SV. In this embodiment, the flow sensor 50 is not necessary.

Ninth Embodiment

Figure 6:
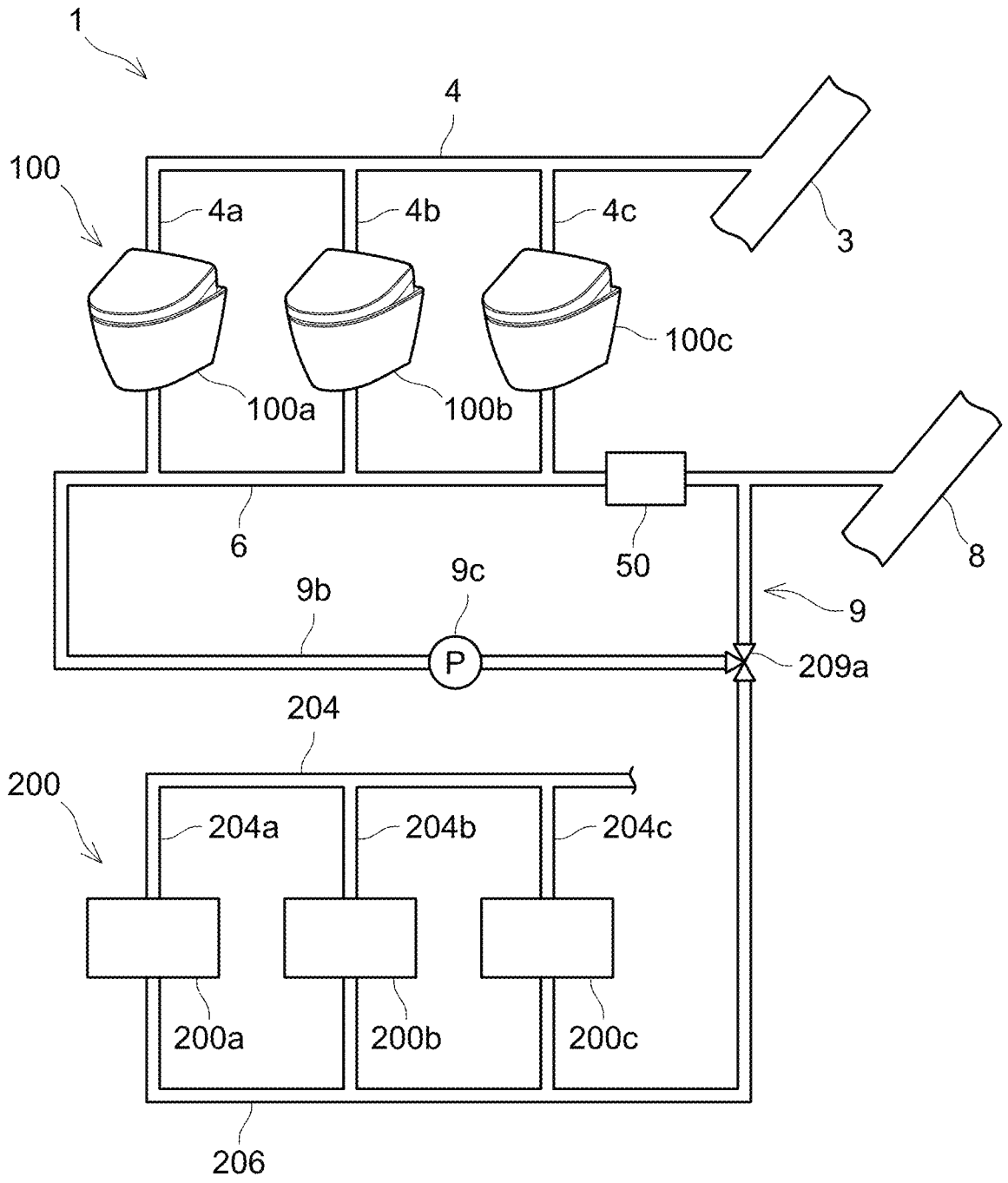
FIG. 6 schematically shows a pipe layout for flush toilets in a management area according to a ninth embodiment.

Differences from the first embodiment will be described. As shown in FIG. 6, in this embodiment, a drainpipe 206 is connected to the circulation pipe 9*b* of the circulation path 9 via a three-way valve 209*a*. The three-way valve 209*a* is located in the middle position of the circulation pipe 9*b*. The three-way valve 209*a* switches the drainpipe 206 between a state in which the drainpipe 206 is in communication with the circulation pipe 9*b* and a state in which the drainpipe 206 is in communication with the drainpipe 6. Usually, the three-way valve 209*a* maintains the drainpipe 206 in the state in which the drainpipe 206 is in communication with the drainpipe 6.

The drainpipe 206 connects each of one or more sanitary facility devices 200 located outside the management area 1 to the sewer pipe 8. Drainage water from each of the one or more sanitary facility devices 200 flows through the drainpipe 206. FIG. 6 shows three sanitary facility devices 200*a*, 200*b*, and 200*c*. However, the one or more sanitary facility devices 200 may be either of one sanitary facility device 200 or two sanitary facility devices 200, or four or more sanitary facility devices 200. Each of the plurality of sanitary facility devices 200 may be a flush toilet. Each of the plurality of sanitary facility devices 200 may be a device that uses water supplied from the clean water pipe 3 via a water supply pipe 204, such as a washbasin, sink, bathroom, dishwasher, and washing machine. The plurality of sanitary facility devices 200 may be of the same type or different types.

In S36 of the single-supply water volume determining process, the controller 12 switches the three-way valve 209*a* from the state in which the drainpipe 206 is in communication with the drainpipe 6 to the state in which the drainpipe 206 is in communication with the circulation pipe 9*b*, and then activates the pump 9*c*. The pump 9*c* pumps water in the drainpipe 206 toward the upstream end of the drainpipe 6 via the circulation pipe 9*b*. This can remove the clogging in the drainpipe 6.

Tenth Embodiment

Figure 7:
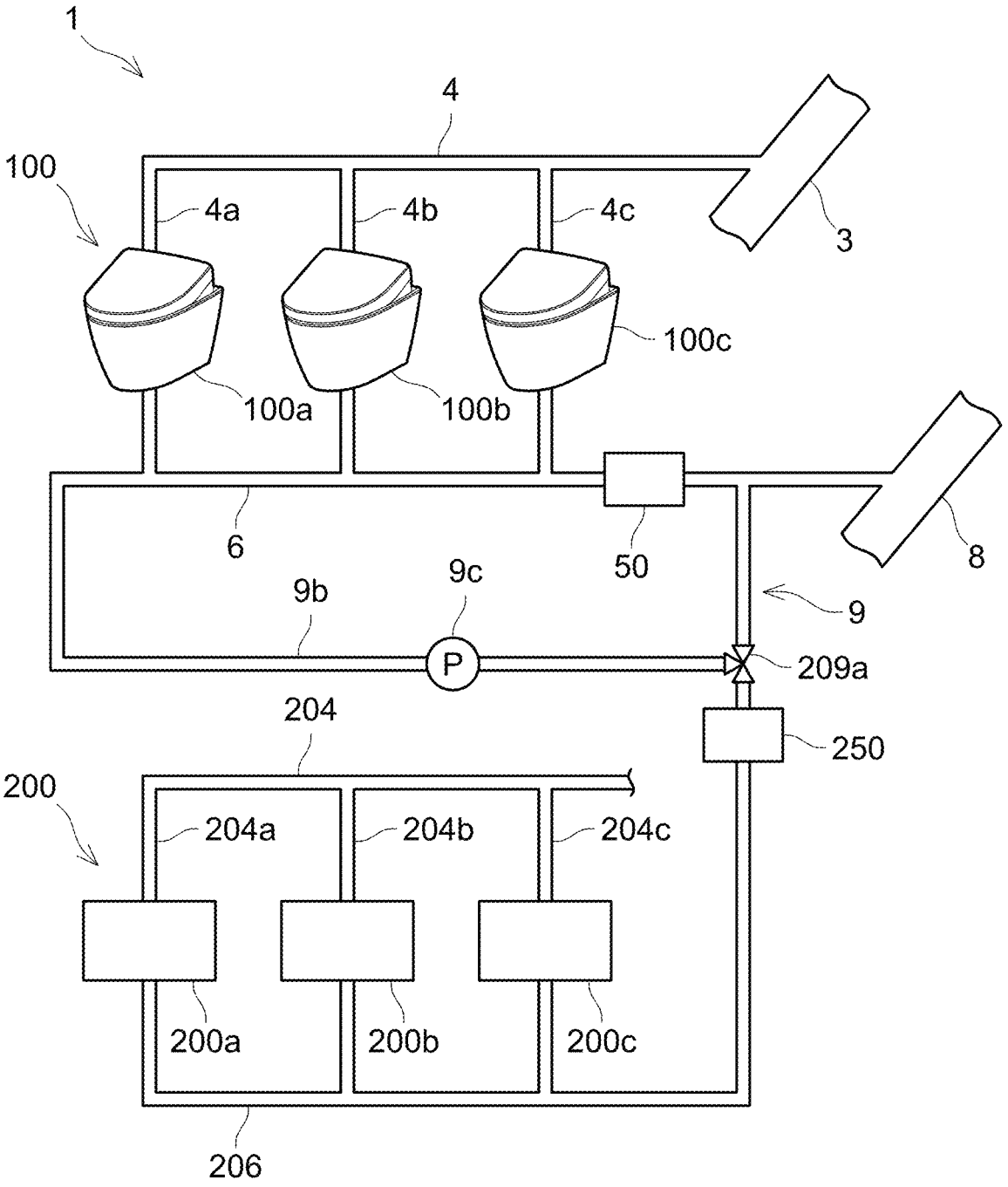
FIG. 7 schematically shows a pipe layout for flush toilets in a management area according to a tenth embodiment.

Differences from the ninth embodiment will be described. In this embodiment, as shown in FIG. 7, the one or more sanitary facility devices 200 are located within the management area 1. The control device 10 controls water supply to the one or more sanitary facility devices 200. Specifically, it distributes the target water volume set for the management area 1 to the plurality of flush toilets 100 and the one or more sanitary facility devices 200. The controller 12 sets a first target water volume for the plurality of flush toilets 100 and sets a second target water volume for the one or more sanitary facility devices 200. The total of the first target water volume and the second target water volume is equal to the target water volume. The first target water volume and the second target water volume are determined depending on the number of the flush toilets 100 and the number of the one or more sanitary facility devices 200. For example, in a case where the plurality of flush toilets 100 is three flush toilets and the one or more sanitary facility devices 200 are two sanitary facility devices, the first target water volume=target water volume×3/5 and the second target water volume=target water volume×2/5. In a variant, the first target water volume and the second target water volume may be determined by considering a water volume used at one time in each of the plurality of flush toilets 100 and the one or more sanitary facility devices 200.

The flow sensor 50 is located in a portion of the drainpipe 6 that is upstream of a position at which the drainpipe 206 joins the drainpipe 6. A flow sensor 250 is located in a portion of the drainpipe 206 that is upstream of the position at which the drainpipe 206 joins the drainpipe 6. The controller 12 executes the water supply controlling process and the single-supply water volume determining process for each of the plurality of flush toilets 100 and the one or more sanitary facility devices 200 by using the first target water volume and the second target water volume. The one or more sanitary facility devices 200 may include device(s) that allows a user to adjust a water volume supplied therefrom. For example, a device that allows a user to adjust the start and stop of water supply, such as a washbasin device, may be included. In this case, its single-supply water volume SV is the maximum volume of water supplied from the start to the stop of a single water supply. When a water volume supplied from the start of a single water supply exceeds the single-supply water volume SV, the water supply may be stopped. When receiving information indicating that a sanitary facility device was used from the sanitary facility device used by the user in S14 together with its identification information, the controller 12 increments count information indicating a count of water supply, which is stored in association with the identification information. The controller 12 calculates the actual water volume by multiplying the single-supply water volume SV by the count of water supply.

In a variant, a circulation path may be provided that connects the portion of the drainpipe 6 upstream of the position at which the drainpipe 206 joins the drainpipe 6 to the upstream end of the drainpipe 206. The circulation path may have a configuration similar to that of the circulation path 9 according to the ninth embodiment. In a variant, the controller 12 may execute the water supply controlling process and the single-supply water volume determining process to a plurality of sanitary facility devices including the plurality of flush toilets 100 and the one or more sanitary facility devices 200, by using a single target water volume.

While specific examples of the present disclosure have been described above in detail, these examples are merely illustrative and place no limitation on the scope of the patent claims. The technology described in the patent claims also encompasses various changes and modifications to the specific examples described above. Variants of the above-described embodiments will be described below.

(1) The water supply controlling process of the first embodiment described above may be replaced by the combination of the water supply controlling processes of the two embodiments of the third and fourth embodiments described above. Specifically, the controller 12 may correct single-supply water volumes SV depending on the frequency of use and the time of year in S12. For example, the controller 12 may multiply single-supply water volumes SV calculated in the single-supply water volume determining process by corresponding season coefficient and date-and-time coefficient.

(2) The single-supply water volume determining process of the first embodiment described above may be replaced by a combination of at least two of the single-supply water volume determining processes of the second, fifth, and seventh embodiments described above. For example, the single-supply water volume determining process of the first embodiment may be replaced by the combination of the single-supply water volume determining processes of the three embodiments of the second, fifth, and seventh embodiments described above. In the single-supply water volume determining process, the controller 12 may calculate, in S38 of the single-supply water volume determining process of the fifth embodiment shown in FIG. 5, a new single-supply water volume SV={current single-supply water volume SV+(target water volume−actual water volume)×(the count of flushing in the flush toilet/the total count of flushing in the plurality of flush toilets)× pipe length coefficient}. In case of combining the single-supply water volume determining processes of the second and fifth embodiments described above, the controller 12 may calculate, in S38 of the single-supply water volume determining process of the fifth embodiment shown in FIG. 5, a new single-supply water volume SV={current single-supply water volume SV+(target water volume−actual water volume)×(the count of flushing in the flush toilet/the total count of flushing in the plurality of flush toilets). In case of combining the single-supply water volume determining processes of the fifth and seventh embodiments described above, the controller 12 may calculate, in S38 of the single-supply water volume determining process of the fifth embodiment shown in FIG. 5, a new single-supply water volume SV={current single-supply water volume SV+(target water volume−actual water volume)×pipe length coefficient}. In case of combining the single-supply water volume determining processes of the second and seventh embodiments described above, the controller 12 may calculate, in S38 of the single-supply water volume determining process of the first embodiment shown in FIG. 3, a new single-supply water volume SV={current single-supply water volume SV+(target water volume−actual water volume)×(the count of flushing in the flush toilet/the total count of flushing in the plurality of flush toilets)× pipe length coefficient}.

(3) The controller 12 may execute each of the water supply controlling process according to the variant (1)

described above and the single-supply water volume determining process according to the variant (2) described above.

(4) The water supply controlling process of the sixth embodiment described above may be replaced by the water supply controlling processes of the third and fourth embodiments described above and the variant (1) described above.

(5) The single-supply water volume determining process of the sixth embodiment described above may be combined with the single-supply water volume determining processes of the second, fifth, seventh embodiments and the variant (2).

(6) In the embodiments and variants described above, at least one of a flow velocity sensor and an image analysis device using an image in the drainpipe 6 may be provided in place of the flow sensor 50. In the embodiments described above, at least one of a flow velocity sensor and an image analysis device using an image in the drainpipe 6 may be provided in addition to the flow sensor 50. In S32, the controller 12 may use at least one of the flow velocity sensor and the image analysis device using an image in the drainpipe 6 to determine whether the drainpipe 6 is clogged or not.

(7) In the embodiments and variants described above, the controller 12 may determine whether the drainpipe 6 is expected to be clogged or not in S32, instead of determining whether the drainpipe 6 is clogged or not. The controller 12 may predict that the drainpipe 6 is expected to be clogged if clogging is likely to occur, even when the drainpipe 6 is not clogged. For example, the controller 12 may determine that the drainpipe 6 is expected to be clogged (YES in S32) if the water volume difference between the actual water volume within the first time period and the integral of drainage water volumes acquired in S16 exceeds a predetermined value. The predetermined value may be smaller than the predetermined value used in S32 of the embodiments.

(8) The flow sensor 50 may be located in at least one of the drainpipe 6 and branch pipes 6*a*, 6*b*, 6*c*.

(9) In the embodiments described above, the controller 12 calculates the actual water volume by multiplying each single-supply water volumes SV by at least one of corresponding count of flushing and count of water supply. Instead of this, a detection device that detects a flow volume of water flowing in each of the branch pipes 4*a*, 4*b*, and 4*c* may be provided. The controller 12 may calculate the actual water volume by integrating the flow volumes obtained from the detection device for the respective branch pipes 4*a*, 4*b*, and 4*c*.

(10) In the embodiments and variants described above, if it is determined that there is no clogging in the single-supply water volume determining process (NO in S32), the single-supply water volume determining process is terminated without determining new single-supply water volumes SV. In a variant, if it is determined that there is no clogging in the single-supply water volume determining process (NO in S32), the controller 12 may determine water volumes less than the current single-supply water volumes SV as new single-supply water volumes SV. Reducing the single-supply water volumes SV when there is no clogging allows for a reduction in water volume to be used.

(11) In the embodiments and variants described above, single-supply water volumes SV may be corrected depending on the region in which the management area 1 is located. For example, in S12 of the water supply controlling process, the controller 12 may calculate corrected single-supply water volumes SV by multiplying the single-supply water volumes SV by a region coefficient. The region coefficient may be depended on at least one of a country and a local government. This allows single-supply water volumes to be determined depending on the region even when at least one of regulations regarding the use of sanitary facility devices and regulations regarding setting of single-supply water volume differs among regions.

(12) The plurality of flush toilets 100 may include urinals. Single-supply water volumes for urinals may be set less than single-supply water volumes SV for flush toilets excluding urinals. For example, in S12, the controller 12 may calculate a single-supply water volume for a urinal by multiplying a single-supply water volume SV by a predetermined coefficient (e.g., 0.6).

While specific examples of the present disclosure have been described above in detail, these examples are merely illustrative and place no limitation on the scope of the patent claims. The technology described in the patent claims also encompasses various changes and modifications to the specific examples described above. The technical elements explained in the present description or drawings provide technical utility either independently or through various combinations. The present disclosure is not limited to the combinations described at the time the claims are filed. Further, the purpose of the examples illustrated by the present description or drawings is to satisfy multiple objectives simultaneously, and satisfying any one of those objectives gives technical utility to the present disclosure.

The invention claimed is:

1. A control device comprising:

a controller configured to control water volume to be supplied to one or more specific sanitary facility devices of the plurality of sanitary facility devices by using a first indicator and a second indicator, the first indicator being related to an actual water volume actually used in a plurality of sanitary facility devices during a specific period, and the second indicator being related to a target water volume to be used in the plurality of sanitary facility devices during the specific period, and the controller being configured to control the water volume to prevent the actual water volume from exceeding the target water volume.

2. The control device as in claim 1, wherein the first indicator includes water volumes actually used in the respective sanitary facility devices, and the second indicator includes water volumes to be used in the respective sanitary facility devices.

3. The control device as in claim 1, wherein the controller is configured to control the water volume to be supplied to the one or more specific sanitary facility devices by using a difference between the target water volume and the actual water volume.

4. The control device as in claim 3, wherein the controller is configured to control the water volume to be supplied to the one or more specific sanitary facility devices, the water volume to be supplied to the one or more specific sanitary facility devices being increased as the difference between the target water volume and the actual water volume is larger.

5. The control device as in claim 1, wherein the first indicator includes an indicator related to a drainage water flow in a drainpipe in which drainage water from the plurality of sanitary facility devices flows.

6. The control device as in claim 5, wherein the drainpipe comprises:

first drainpipes extending from the respective sanitary facility devices; and a second drainpipe to which the first drainpipes are connected, and the first indicator includes a volume of drainage water flowing in the second drainpipe.

7. The control device as in claim 1, wherein the controller is configured to control the water volume to be supplied to the one or more specific sanitary facility devices by further using a third indicator related to frequency of use of the plurality of sanitary facility devices.

8. The control device as in claim 1, wherein the controller is configured to control the water volume to be supplied to the one or more specific sanitary facility devices by further using an additional indicator, the additional indicator being related to at least one of: time when each of the sanitary facility devices is used, a temperature around each of the sanitary facility devices, operation statuses of the plurality of sanitary facility devices, and construction states of the plurality of sanitary facility devices.

9. The control device as in claim 1, wherein the controller is configured to supply water flowing in a water pipe different from the drainpipe to the drainpipe in a case where a drainpipe in which drainage water from the plurality of sanitary facility devices flows is clogged.

10. The control device as in claim 1, wherein the plurality of sanitary facility devices includes a flush toilet.

11. The control device as in claim 1, wherein the plurality of sanitary facility devices is located in one management area.

12. A water supply and drainage system, comprising:

a plurality of sanitary facility devices; and the control device of claim 1.

* * * * *